US006848412B2

(12) United States Patent
Maier et al.

(10) Patent No.: US 6,848,412 B2
(45) Date of Patent: Feb. 1, 2005

(54) INTERNAL COMBUSTION ENGINE

(75) Inventors: Frank Maier, Ditzingen Hirschlanden (DE); Markus Huber, Munich (DE)

(73) Assignee: Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 10/307,525

(22) Filed: Dec. 2, 2002

(65) Prior Publication Data

US 2003/0132063 A1 Jul. 17, 2003

(30) Foreign Application Priority Data

Dec. 1, 2001 (DE) ..... 101 59 104

(51) Int. Cl.[7] ..... F01M 9/10
(52) U.S. Cl. ..... 123/196 R; 123/190 S
(58) Field of Search ..... 123/196 R, 196 S

(56) References Cited

U.S. PATENT DOCUMENTS

| | | | | | |
|---|---|---|---|---|---|
| 5,130,014 | A | * | 7/1992 | Volz | 123/196 R |
| 6,047,678 | A | * | 4/2000 | Kurihara et al. | 123/196 R |
| 6,116,205 | A | * | 9/2000 | Troxler et al. | 123/196 R |
| 6,247,440 | B1 | * | 6/2001 | Gron, Jr. | 123/196 R |
| 6,260,533 | B1 | * | 7/2001 | Tanaka | 123/196 R |
| 6,293,263 | B1 | * | 9/2001 | Middlebrook | 123/196 R |
| 6,578,541 | B2 | * | 6/2003 | Stromsky et al. | 123/196 R |
| 6,644,262 | B2 | * | 11/2003 | Matsuda et al. | 123/196 R |

FOREIGN PATENT DOCUMENTS

| | | | |
|---|---|---|---|
| DE | 2843248 | A1 | 4/1980 |
| DE | 4431088 | A1 | 3/1996 |
| DE | 10014368 | A1 | 10/2001 |
| EP | 0662581 | A2 | 7/1995 |
| JP | 60-47821 | | 3/1985 |
| JP | 9-151718 | | 6/1997 |
| JP | 2002-61309 | | 2/2002 |

* cited by examiner

*Primary Examiner*—Henry C. Yuen
*Assistant Examiner*—Jason Benton
(74) *Attorney, Agent, or Firm*—Crowell & Moring LLP

(57) ABSTRACT

An internal combustion engine includes an oil collector housing positioned beneath a crankcase housing. A lubricating oil pump is positioned inside the oil collector housing, and the oil collector housing contains at least one oil-collecting chamber, into which an oil suction line leads from the lubricating oil pump, forcing the lubricating oil through the delivery side to consumers. A system for supplying lubricating oil to the drive shaft of at least one turbocharger is mounted on the internal combustion engine. The lubricating oil that is fed to the turbocharger is returned via oil lines to the oil-collecting chamber of the internal combustion engine. At least one ascending channel is integrated into the oil collector housing, via which the lubricating oil that has been suctioned off from the turbochargers is returned above the oil level in the oil collecting chamber. Lubricating oil being returned from the turbocharger will be returned above the oil level in the oil trap of the internal combustion engine, even when the vehicle is traveling downhill.

1 Claim, 4 Drawing Sheets

INTERNAL COMBUSTION ENGINE

This application claims the priority of German application 101 59 104.7, filed Dec. 1, 2001, the disclosure of which is expressly incorporated by reference herein.

Reference, is also made to copending U.S. application Ser. No. 10/307,507, filed on the same date as the present application, titled "INTERNAL COMBUSTION ENGINE".

BACKGROUND AND SUMMARY OF THE INVENTION

The present invention relates to an internal combustion engine having an oil collector housing positioned beneath a crankcase housing, a lubricating oil pump positioned inside the oil collector housing, the oil collector housing containing at least one oil-collecting chamber, into which one oil suction line from the lubricating oil pump leads, forcing lubricating oil through a delivery side to consumers, and a system for supplying the lubricating oil to a drive shaft of at least one turbocharger mounted on the internal combustion engine. In such an engine, the lubricating oil that is fed to the turbocharger is returned via oil lines to the oil-collecting chamber of the internal combustion engine.

Internal combustion engines with turbo-charging require an adequate supply of lubricating oil for the drive shafts of the turbochargers. One lubricating oil supply system of this type, in which oil is fed to the drive shaft via a line leading to the turbocharger from the crankcase of the internal combustion engine, is known from European publication EP 0 662 581 A2. In most cases, the lubricating oil that is fed to the drive shaft of the turbocharger is then returned via corresponding return lines to the internal combustion engine's oil trap. To support the return of the oil, separate oil suction pumps are necessary in many cases.

One object of the invention is to provide a system for returning the lubricating oil from the turbocharger to the oil trap via an oil suction pump in such a way that will ensure that the oil will enter the oil trap above the oil level, even when a vehicle is traveling downhill.

This object is attained by having at least one ascending channel integrated into the oil collector housing, via which the lubricating oil that has been suctioned off from the at least one turbocharger is returned above an oil level in the oil-collecting chamber.

By integrating at least one ascending channel into the oil collector housing, it can be ensured that the lubricating oil that is suctioned off by the turbocharger-suction pump will be returned above the oil level in the oil trap, even when the vehicle is traveling downhill. The solution is simple and cost-effective, since no additional, external lines are required. The oil is delivered into the oil trap relatively far away from the point of suction by the main oil pump; this allows the returned lubricating oil sufficient time to defoam.

Further advantageous embodiments of and improvements on the internal combustion engine specified are reflected in dependent claims. In order to guarantee sufficient distance between the oil entry point and the oil level, the ascending channel leads up into a control valve assembly cover in the internal combustion engine.

One embodiment of the invention is specified in detail in the following description and is shown in the drawings.

DETAILED DESCRIPTION OF THE INVENTION

Figure 1:
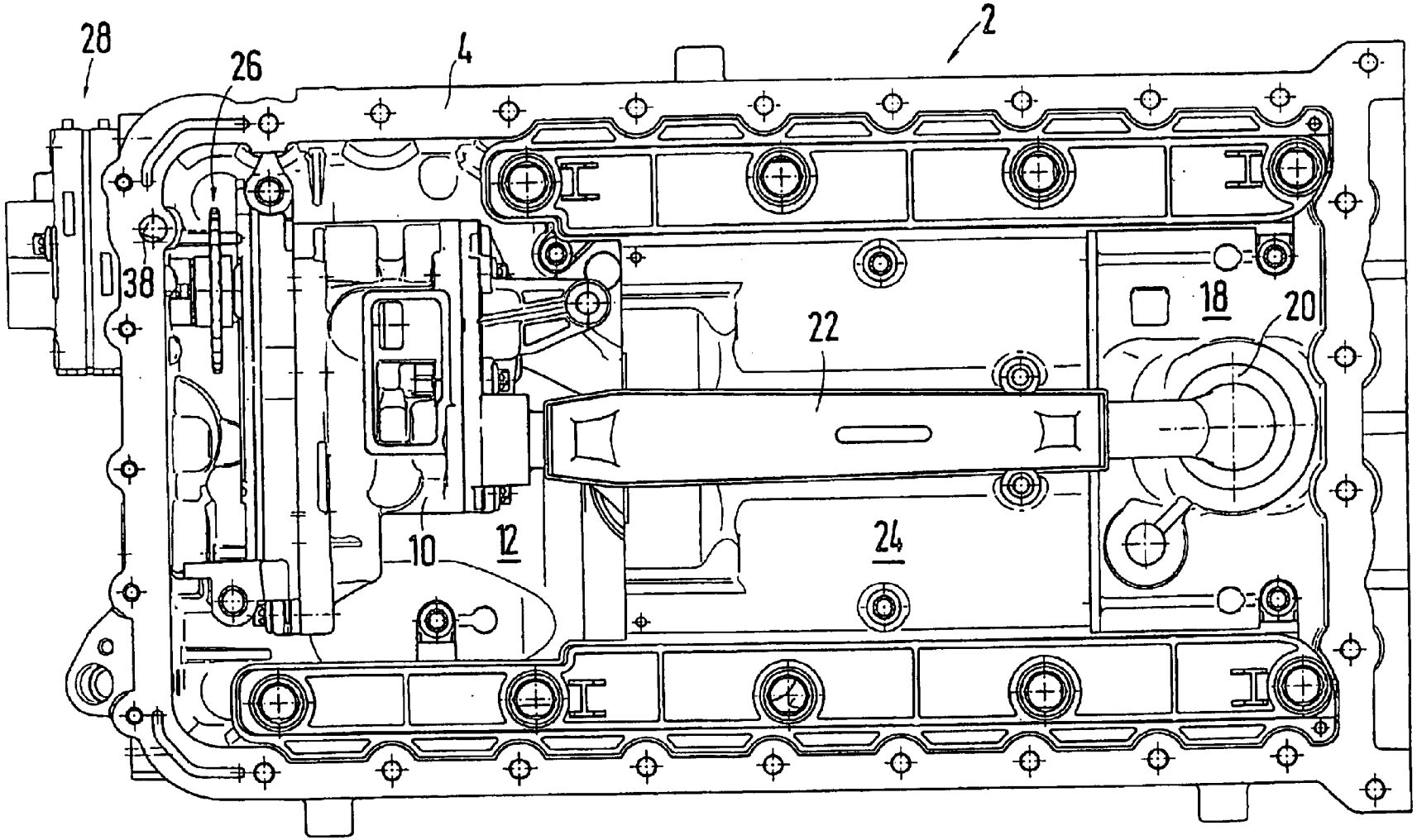
FIG. 1 is an overhead view of an oil collector housing in an internal combustion engine.
Figure 2:
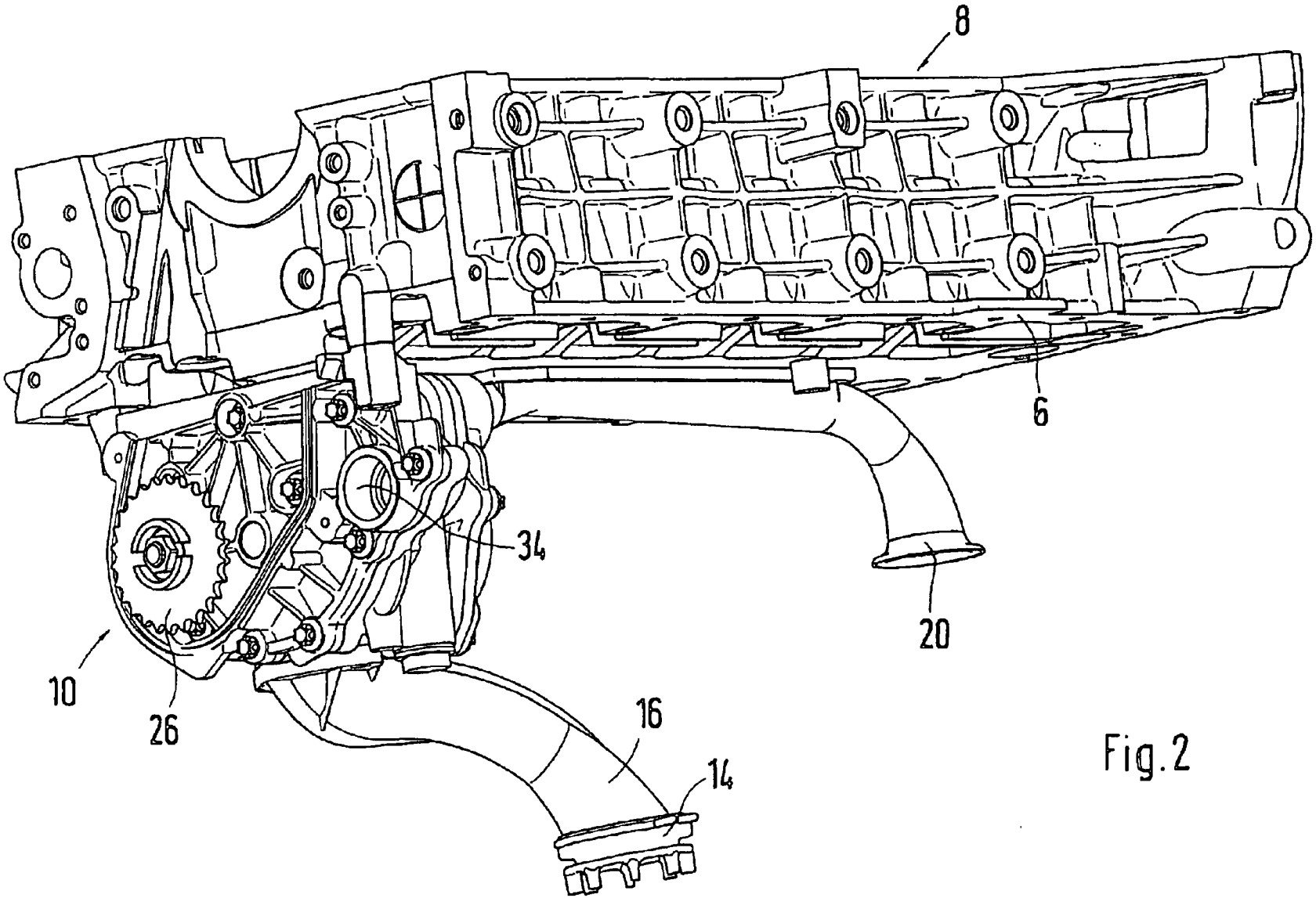
FIG. 2 is a lubricating oil pump, flange-mounted to the base of a crankcase.
Figure 3:
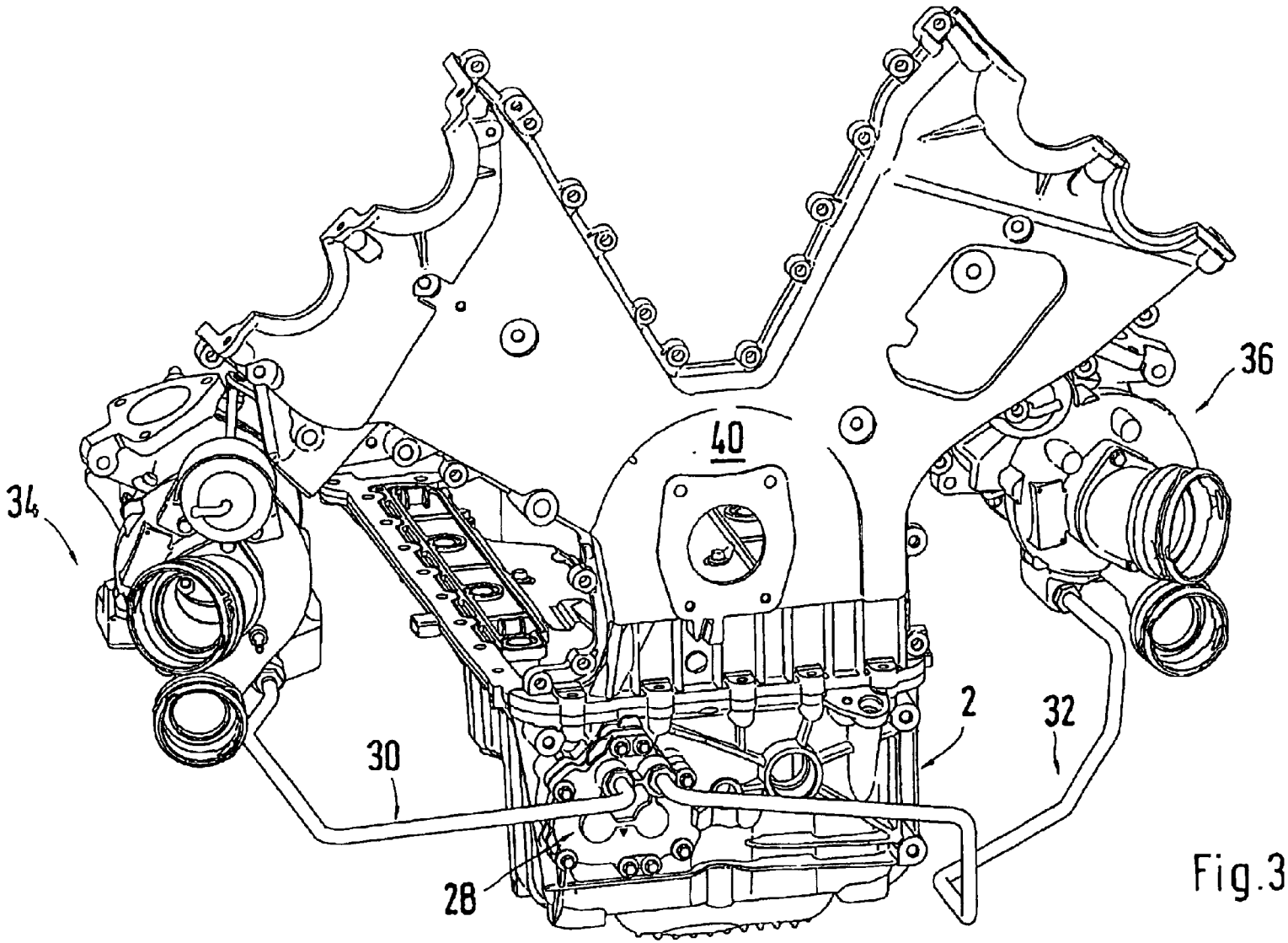
FIG. 3 is a frontal view of the internal combustion engine, with two turbochargers.
Figure 4:
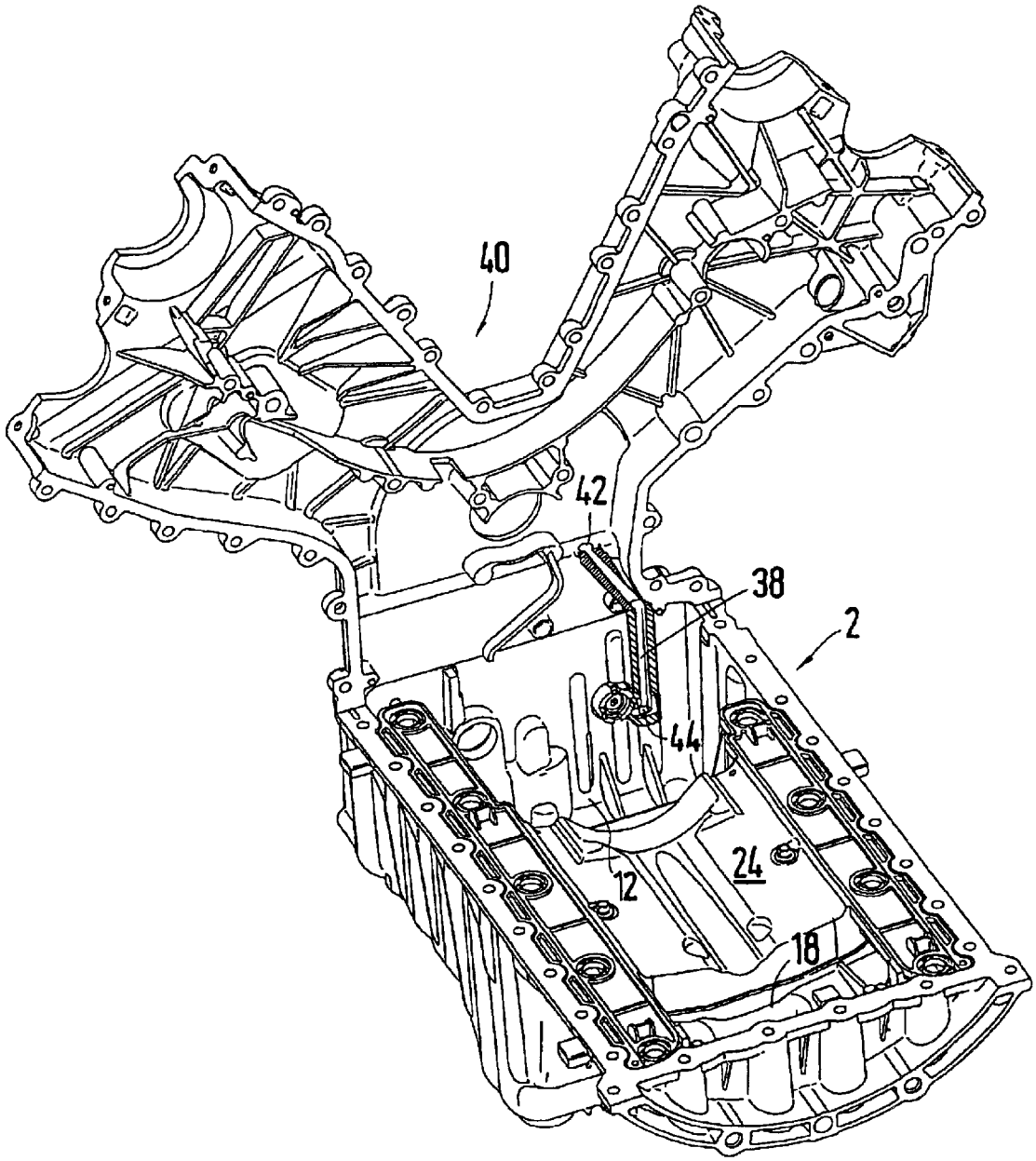
FIG. 4 is another view of the oil collector housing and a control valve assembly cover in the internal combustion engine.

The oil collector housing in FIG. 1, hereinafter referred to as the oil pan 2, is shown in an assembled state with its flange surface 4 mounted against a flange surface 6 of an base section of a crankcase 8, a so-called bed plate. A lubricating oil pump 10, designed as a dual pump, is mounted on the base of the crankcase 8. The oil pan 2 contains a first oil-collecting chamber 12, in which the oil necessary for lubrication is gathered in an oil trap. An oil snorkel 14 is positioned in the first oil-collecting chamber 12, and leads via a first oil suction line 16 to the suction side of a first pump stage of the lubricating oil pump 10. A second, rear oil-collecting chamber 18 is provided in the oil pan 2, also with an oil snorkel 20 connected to it at its deepest point; this oil snorkel is connected via a second oil suction line 22 to the suction side of a second pump stage of the lubricating oil pump 10.

A plastic insert 24 is installed in the oil pan 2, separating the two oil-collecting chambers 12 and 18 from each other. The insert 24 serves as an oil barrier and prevents the lubricating oil from spilling over from the first oil-collecting chamber 12 into the crankcase and/or into the second oil-collecting chamber 18. The lubricating oil from the main bearings of the crankshaft, and the lubricating oil from the spraying nozzles used to cool the pistons, not illustrated here, is collected in the second oil-collecting chamber 18, and is returned via the second oil suction line 22 to the first oil-collecting chamber 12.

The oil pump 10 is driven via a sprocket 26, which is connected via a chain drive to a crankshaft sprocket, which is not illustrated here. Further, a turbocharger-suction pump 28 is flanged to the end face of the oil pan 2, and also is driven via the sprocket 26. The oil suction pump 28, which also is designed as a dual pump, is equipped with two oil return lines 30 and 32, each of which is connected to a turbocharger 34 and 36. The turbochargers 34 and 36 are fastened in a known art and manner to the exhaust manifold (not illustrated here) of the internal combustion engine, which in this case is designed as a V-motor. On the end face of the oil pan 2 to which the oil suction pump 28 is mounted, an ascending channel 38 is integrated into the oil pan housing; the function of this channel will be described in greater detail below.

The ascending channel 38 extends into a control valve assembly cover 40 of the internal combustion engine, and is equipped with an outlet opening 42, positioned far above the oil trap in the oil-collecting chamber 12. Via the ascending channel 38, the lubricating oil for the drive shafts of the two turbochargers 34 and 36 that has been suctioned off via the return lines 30 and 32 is returned to the oil-collecting chamber 12 in the oil pan 2. The oil suction pump 28, which is designed as a dual pump, is equipped with only one outlet on its delivery side; this outlet is connected to an oil intake opening 44 in the ascending channel 38. Because the ascending channel 38 discharges above the oil pan 2, it is ensured that even when the vehicle is driving downhill, the lubricating oil that has been suctioned off by the suction pump 28 will be discharged above the oil level in the oil collecting chamber 12. Hence, this oil has time to defoam before it is returned to consumers by the main lubricating oil pump 10.

The ascending channel 38 integrated into the end face of the oil pan 2 further serves to ensure an adequate distance from the suction point of the lubricating oil pump 10; this measure also serves to provide sufficient time for the lubricating oil that has been suctioned off from the turbochargers 34, 36 to defoam.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. An internal combustion engine comprising:

an oil collector housing positioned beneath a crankcase housing;

a lubricating oil pump positioned inside said oil collector housing, the oil collector housing containing at least one oil-collecting chamber, into which one oil suction line from the lubricating oil pump leads, forcing lubricating oil through a delivery side to consumers; and a system for supplying the lubricating oil to a drive shaft of at least one turbocharger mounted on the internal combustion engine, wherein the lubricating oil that is fed to the turbocharger is returned via oil lines to the oil-collecting chamber of the internal combustion engine, wherein at least one ascending channel is integrated into the oil collector housing, via which the lubricating oil that has been suctioned off from the at least one turbocharger is returned above an oil level in the oil-collecting chamber, and wherein the at least one ascending channel extends into a control valve assembly cover of the internal combustion engine.

* * * * *